US005671716A

United States Patent [19]

Hetrick et al.

[11] Patent Number: 5,671,716

[45] Date of Patent: Sep. 30, 1997

[54] FUEL INJECTION SYSTEM AND STRATEGY

[75] Inventors: Robert Eugene Hetrick, Dearborn Heights; Harold Sean Hilbert, Canton; Michael Howard Parsons, Ann Arbor; William Francis Stockhausen, Northville, all of Mich.

[73] Assignee: Ford Global Technologies, Inc., Dearborn, Mich.

[21] Appl. No.: 725,045

[22] Filed: Oct. 3, 1996

[51] Int. Cl.[6] ..... F02M 51/00

[52] U.S. Cl. ..... 23/491

[58] Field of Search ..... 123/491, 446, 123/578, 506, 502, 129.17, 531, 472, 494; 239/690, 706, 97; 60/740, 741, 742

[56] References Cited

U.S. PATENT DOCUMENTS

| | | | |
|---|---|---|---|
| 3,616,784 | 11/1971 | Barr | 123/179.17 |
| 3,716,034 | 2/1973 | Schmid | 123/179.17 |
| 4,077,374 | 3/1978 | Willmann et al. | 123/536 |
| 4,753,211 | 6/1988 | Hofer | 123/502 |
| 4,753,212 | 6/1988 | Miyaki et al. | 123/506 |
| 4,936,280 | 6/1990 | Langlois | 123/578 |
| 5,033,439 | 7/1991 | Eygret | 123/491 |
| 5,054,458 | 10/1991 | Wechem et al. | 239/135 |
| 5,129,381 | 7/1992 | Nakajima | 123/531 |
| 5,181,494 | 1/1993 | Ausman et al. | 123/446 |
| 5,224,458 | 7/1993 | Okada et al. | 123/531 |
| 5,234,170 | 8/1993 | Schirmer et al. | 123/538 |
| 5,598,826 | 2/1997 | Hunt et al. | 123/491 |

*Primary Examiner*—Raymond A. Nelli
*Attorney, Agent, or Firm*—Peter Abolins

[57] ABSTRACT

A fuel injection system used in the intake air passageway of an internal combustion engine has a strategy for reducing cold start hydrocarbon emissions. The fuel injector has an actuator which allows the fuel spray pattern to be varied from one which is widely dispersed and atomized to one which is only weakly dispersed. A strategy for varying the spray pattern during the engine warm-up period after cold start is disclosed. The strategy increases evaporation within the passageway so that cold start overfuelling and attendant hydrocarbon emissions are reduced.

16 Claims, 2 Drawing Sheets

FUEL INJECTION SYSTEM AND STRATEGY

BACKGROUND OF THE INVENTION

1. Field of the Invention

This invention relates to a strategy for cold starting an internal combustion engine.

2. Prior Art

The cold start condition for the internal combustion engine has always required a special, temporary fueling strategy. Regardless of whether the engine is carbureted or fuel injected, overfuelling (fuel in excess of the amount required to react with all of the oxygen molecules that are simultaneously inducted into the combustion chamber) is usually required to insure enough combustible vapor for prompt starting. A consequence of overfuelling is the appearance of undesirably large levels of tailpipe hydrocarbon emissions during the first minutes of engine warm up. One strategy for overcoming this is to manipulate the vapor pressure of the fuel via varied fuel formulations, as now occurs seasonally. However, this approach has it limits due to the potential occurrence of vapor lock in the fuel delivery system under fully warmed conditions. Other approaches have been proposed for preparing or presenting the fuel in a manner to facilitate cold starting. These approaches attempt to exploit such factors as fuel surface area, heat transfer to the fuel, and the convective flow of the air adjacent to the condensed fuel to maximize evaporation.

U.S. Pat. No. 3,616,784 to Barr describes components and circuitry which result in fuel enrichment from an electronic fuel injection system during the cranking or starting period of engine operation. The enrichment is effected by an actuator (usually a solenoid) which acts to keep the valve of the injector open for a longer period than would be required to produce a stoichiometric air/fuel mixture for induction into the combustion chamber. Fuel enrichment may be required whether the fuel is injected into a port upstream of the combustion chamber or directly into the chamber. Fuel is injected at a constant flowrate. Temperature sensors are incorporated into the system so that the amount of overfuelling can be reduced as the temperature and accordingly the amount of vaporized fuel increases.

Another way of alleviating cold start problems is to heat the fuel in the injector itself. U.S. Pat. No. 5,054,458 to Wechem et al. describes an injector incorporating ceramic heating elements which come into contact with the fuel, thereby promoting vaporization and spray droplets of smaller sizes.

A favored approach for improving vaporization is to devise an injector which produces a more finely atomized spray. This results in more surface area for the same amount of fuel and, therefore, enhanced evaporation. Prior art describes a number of injector types for accomplishing this, including those which use a high fuel pressure in forcing the fuel out of an orifice. Air-assist injectors are described which use high velocity air to assist in breaking up a fuel stream into small droplets. In these devices, a high degree of atomization is achieved by adding kinetic energy to the fuel droplets. Within the limited confines of the intake port, this added energy may only serve to drive the droplets to the port wall where a fuel film of lesser surface area forms. Other fuel injection systems have been described in which one or more cold start injectors are mounted in the intake manifold to provide the required additional vapor. Many factors have been described which affect fuel presentation and fuel evaporation in the intake port. These factors suggest that no single spatial (or temporal) fuel presentation pattern could maximize fuel evaporation in the port under all conditions. The present invention remedies that situation by teaching methods of varying the fuel spray pattern as well as a strategy for using that variability in a way which minimizes cold start hydrocarbon emissions.

SUMMARY OF THE INVENTION

While liquid gasoline is convenient for transport, it is only an efficient combustible when present as vapor that is well mixed with air. If gasoline is injected into an intake port of a fully warmed engine before induction into the cylinder, the heat in that region promotes rapid and thorough vaporization and good combustion. For injection into a cold engine (corresponding to an ambient air temperature equal to or less than approximately 70° F.), only a fraction of the fuel will be vaporized. As a result, overfuelling, with its attendant undesirable hydrocarbon emissions, is required for reliable cold starting. Experiments have shown that there are various conditions and processes which can promote vaporization during the residence time of the fuel in the cold and warming intake port but that these may occur at spatially different positions and at different times during the warming process. That is, the fuel presentation that maximizes evaporation will vary with time during engine warm up. The present invention teaches the use of fuel injectors capable of producing variable spray patterns and strategies for achieving those patterns during the warm up period which will maximize vaporization and minimize hydrocarbon emissions.

DETAILED DESCRIPTION OF THE INVENTION

Figure 1:
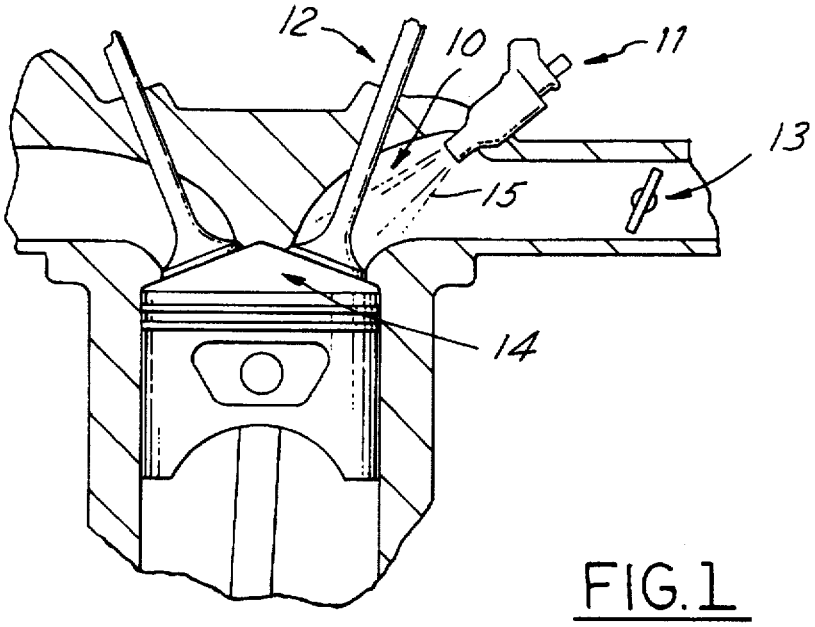
FIG. 1 is a schematic diagram of the intake port through which air and injected fuel are inducted into the cylinder of an internal combustion engine.

FIG. 1 shows a schematic drawing of an intake port 10, or intake air passageway, which is qualitatively in the shape of a curved cylinder. Protruding into the port near its upstream end is a fuel injector 11 while at the other extremity is an intake valve 12. When the valve is opened, air (coming into the port volume through a partially opened throttle valve 13 upstream of the injector) and fuel are drawn into the cylinder 14 where combustion occurs after the valve is closed. A typical port volume would be on the order of 80 $cm^3$ while a typical interior surface area might roughly equal 100 $cm^2$. Injection of fuel 15 into port 10 results in fuel present in the form of vapor, as well as in the condensed phase in the form of airborne droplets and films on the port walls. If injection occurs before valve 12 opens, the fuel in condensed form has a residence time in port 10 during which it can vaporize before induction into cylinder 14. Since only fuel vapor is burned, maximizing the vapor phase helps to ensure an effective and efficient combustion event. For example, if an injection were to occur immediately after throttle valve 13 closes, the fuel would have approximately 100 msec to evaporate at 1000 rpm and as long as 500 msec during the cranking period occurring at about 200 rpm) at engine startup.

Temperature within port 10 is a key factor in optimizing port evaporation. Thus, at part throttle, 0.04 $cm^3$ of fuel may be injected into port 10 under conditions where the engine is fully warmed. At a 70° F. cold start, however, this amount may have to be increased to 0.2 $cm^3$ (corresponding to an injector activation time of some tens of milliseconds depending on the fuel flowrate), or five times the amount required for reaction with the mass of air that is simultaneously inducted, to realize enough vaporization to achieve combustion. The extra hydrocarbons from this overfuelling result in excess hydrocarbon (HC) emissions as the engine warms up.

To reduce cold start HC emissions, cold start overfuelling can be reduced by vaporizing as much of the injected hydrocarbons as possible. Assuming that the vapor pressure of a typical gasoline at a 70° F. cold start is approximately 50 kPa, a simple ideal gas calculation reveals that the port volume is large enough so that even a typical excess amount of injected gasoline (e.g. 0.2 $cm^3$) should evaporate completely when given enough time. Accelerating the rate of evaporation in the limited residence time available by spatially positioning the fuel within port 10 in an optimum manner reduces the amount of overfuelling. The factors involved in accelerating the fuel evaporation are the temperature of the gas within the port, the surface area and volume of the port, the surface area of the injected gasoline, the time between the start of injection and the opening of the intake valve, the pressure within the port, the magnitude of the convective flow of the gas phase with respect to the condensed fuel phase, and the vapor pressures of the various hydrocarbon components within the fuel. Some of these factors will be changing within the short time interval during which the engine is warming up.

A number of fuel injection devices have been advanced to produce a spray pattern which produces a rapid rate of evaporation. One common approach is to highly atomize the fuel with high pressure or compressed gas to produce very tiny fuel droplets with an attendant high surface area for evaporation. Additionally, when the intake valve is opened, the tiny airborne droplets may be entrained in the air flow and drawn into the combustion chamber where they will experience the heat of compression which may further enhance evaporation before combustion. One problem with this approach is that the high atomization is usually produced by giving the fuel additional kinetic energy on leaving the injector. Within the confines of the small port geometry, this energy may well drive many of the tiny fuel droplets to the walls of the port to form of a fuel film (and a reduced surface area) well before the intake valve opens. In effect, a maximum fuel surface area involving both fuel film and fuel droplets may limit the amount of evaporation from this approach. A further problem could occur if energy imparted to the spray to produce high atomization also results in a significant radial velocity (with respect to axis of the port cylinder near the injector) to the droplets. In this case the resulting fuel film may well be localized in the upstream end of the port near the injector. Accordingly, this fuel will not realize the full evaporative potential of the rising temperature of the intake valve as the engine starts to warm. In short, the spatial and temporal variability of the temperature in the port during warm up calls for a concomitant variation in the spatial presentation of the fuel to maximize evaporation.

Other factors besides temperature may call for spatial variability. Thus, during the first few injection events of engine cranking and start up, the pressure in the intake port falls from an initial value of one atmosphere to a value near one-third to one-fourth of an atmosphere as the cylinders pump air from the port when the throttle is only partially opened. This pressure variation will produce a different fuel presentation due to the reduced effect of air resistance on droplet trajectories and enhanced evaporation.

Another factor requiring spatial variability is convective air flow, in which the air and fuel charge within the port can experience large changes in instantaneous velocity as the intake valve is opened and closed. On one hand, large convective flows next to stationary fuel films characterized by sluggish but airborne fuel droplets promote evaporation by increasing the gradient of hydrocarbon immediate neighborhood of the evaporating surfaces. On the other hand, the large flow velocities from the port into the cylinder as the intake valve opens can draw incombustible liquid fuel droplets into the cylinder from fuel films and puddles which may have collected near the bottom of the port due to poor vaporization at cold start. In brief, the ability to vary the spatial pattern of the fuel coming from the injector will provide a valuable additional variable to help realize the maximum evaporation of the injected fuel within the context of these factors.

A number of different technologies such as electrospray and variable hydraulic or gas pressure may be adapted to automotive fuel injectors for varying the spray pattern on a millisecond time scale. Before discussing these, it is appropriate to describe an approximate strategy for the optimum spatial dispersion of the fuel during the warm up period. In doing this, it is realized that the detailed implementation of that strategy (e.g. a temporal schedule for activating the adapted technology that produces the variable pattern) cannot be exactly specified, but will depend on the specific spray pattern from the injector in question, the position of the injector within the port, and the shape of the port volume.

An approximate strategy for maximizing evaporation and minimizing emissions with a "variable-pattern" injector begins with the injection of fuel into the port when the intake valve is closed to allow residence time for evaporation. For the initial injections, a widely dispersed spray pattern would be used to produce as much fuel surface area as possible by fully and thinly coating the walls of the port during this low temperature and nearly isothermal period. In addition to maximizing surface area, the procedure would keep liquid fuel from forming puddles at the top of the intake valve near the bottom of the port. As mentioned before, such puddles are a source of large incombustible droplets that are drawn into the cylinder when the intake valves opens. As the temperature of the port boundary rises during the first tens of seconds after the beginning of combustion, the activation of the spray producing technology would be continuously adjusted to produce a more collimated pattern. Thus, increasing amounts of fuel would be directed to the warmest region of the port boundary in the immediate vicinity of the intake valve and on top of the intake valve.

It is assumed that some of the injected fuel will be present in the form of droplets in addition to wall films and the highly desired full vapor. These will result from atomization processes occurring immediately after injection, from secondary atomization that occurs when high momentum components of the spray impact on the walls of the port, or from strong convective flows that strip atomize fuel films. In view of the many factors involved, little can be said of the relative amounts of fuel in droplet and film form. However, it is not unusual for fuel emerging from a typical low pressure injector to have a velocity on the order 10 m/sec. If the typical furthest distance from injector to port wall is 0.1 m, then it will only take about 10 msec before much of the fuel has its first encounter with the port wall. With a potential residence time between 100 and 500 msec at cold start, it is reasonable to assume that much of the fuel will end up on the port wall.

Figure 2A:
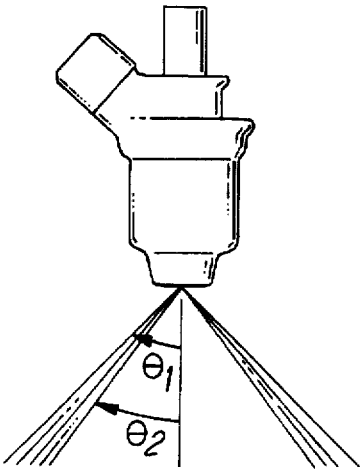
FIG. 2*a* is a schematic diagram illustrating a spray pattern from an injector in which the atomized fuel droplets are present in the form of a hollow cone.
Figure 2B:
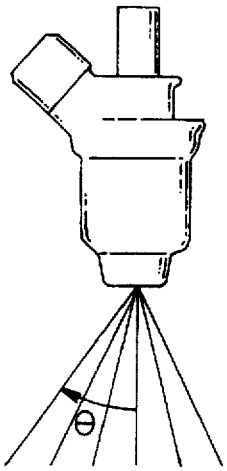
FIG. 2*b* is a schematic diagram illustrating a spray pattern from an injector in which the atomized fuel droplets are uniformly distributed throughout a given solid angle.
Figure 2C:
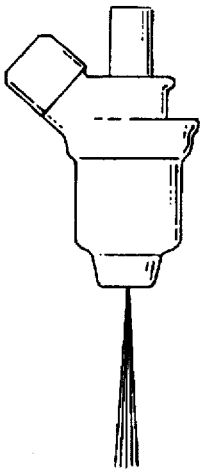
FIG. 2*c* is a schematic diagram illustrating a spray pattern in which the injected fuel is present in the form of a narrow column.

The description of spray patterns is imprecise due to the many parameters involved in their generation and evolution. Further, port geometries are themselves variable. Thus, a variable spray strategy to minimize cold start emissions must be refined by trial and error. FIG. 2 illustrates the situation by showing two extreme cases, each with injectors capable of producing variable spray patterns. The injector of FIG. 2*a* has a pattern such that the dispersed spray is largely contained within the volume defined by two cones with a common apex and is further specified by cone angles $\theta_1$ and $\theta_2$. Prior art describes an injector which produces such a pattern. As the activation which controls the degree of dispersion is increased or reduced, the corresponding magnitudes of the cone angles are also increased or reduced. On the other hand, FIG. 2*b* shows an injector where activation produces a dispersed pattern in which the spray droplets are more or less uniformly distributed over a volume defined by a maximum cone angle $\theta$. FIG. 2*c* shows that at low activation, both sprays have a highly collimated distribution that concentrates the spray near the intake valve for most port geometries. The activation schedule for each type of injector will be different.

Figure 3A:
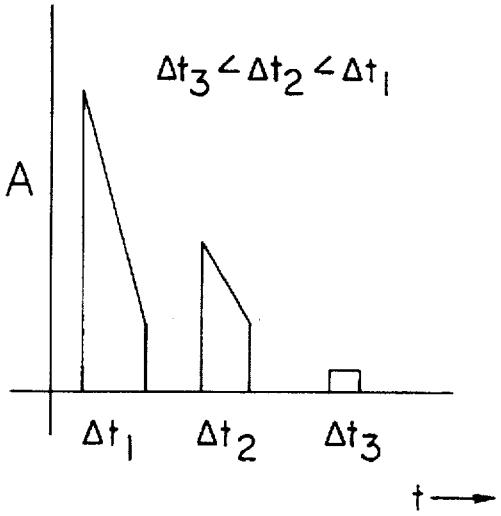
FIG. 3*a* is a schematic diagram illustrating that the magnitude of activation A of an injector, which can produce a variable spray pattern resulting from that activation, may need to be varied from pulse to pulse, and also within a pulse to achieve a desirable fuel presentation during the cold start period.

To implement the cold start strategy discussed above in the context of a hypothetical port comprising a cylinder extending below the injector nozzle, the degree of activation A for the device of FIG. 2*a* (see FIG. 3*a*) will, during the time $\Delta t_1$ of the initial injector pulses, have to be varied from a large to a small value to cause the radially dispersed but spatially localized spray to be spread over the entire port wall. As the engine begins to warm, the initial activation is diminished from that of the previous case, and then the activation is further diminished over the time of the event, $\Delta t_2$, causing the spray to form a film closer to the vicinity of the valve. Note that the time interval for activation is reduced at later times in response to the increased amount of evaporation in the warming port. After the engine is sufficiently warm, the activation is reduced to a single low value over the entire injection period, $\Delta t_3$, so that a fuel film deposits only near the back surface of the intake valve.

Figure 3B:
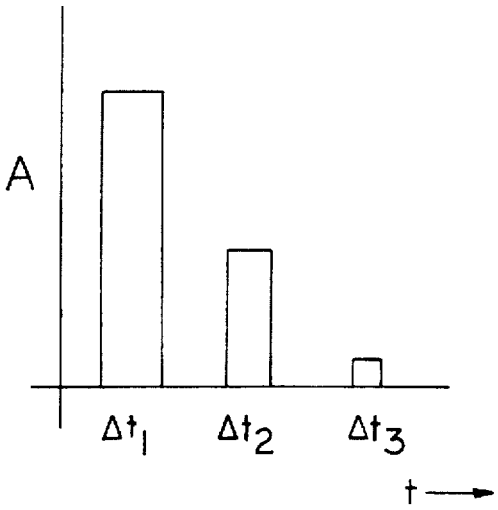
FIG. 3*b* is a schematic diagram illustrating that the activation A may need to be varied only from pulse to pulse to achieve a desirable fuel presentation.

With respect to coating the walls of the hypothetical port, the dispersed pattern of the injector of FIG. 2*b* is more closely matched to the shape of that port. Accordingly, the initial cold start injection events will require only a single high activation value (see FIG. 3*b*) over the period of the initial events to cause the fuel to coat the entire port wall. Similarly, the appropriate activations for intermediate and fully warmed conditions are also single but increasingly smaller values. As in the previous case, the pulse widths of the later injections events are reduced. In refining an activation schedule for a particular case, hydrocarbon emissions would be monitored during the entire cold start period so that the magnitude and temporal variation of the activation may be adjusted to minimize these emissions. In one approach, this schedule and its variations for different cold start temperatures could be retained for use in an on-vehicle computer. In another approach, the implementation might be refined by correlating measured engine parameters such as coolant temperature, manifold pressure, etc. with necessary activation values.

Figure 4:
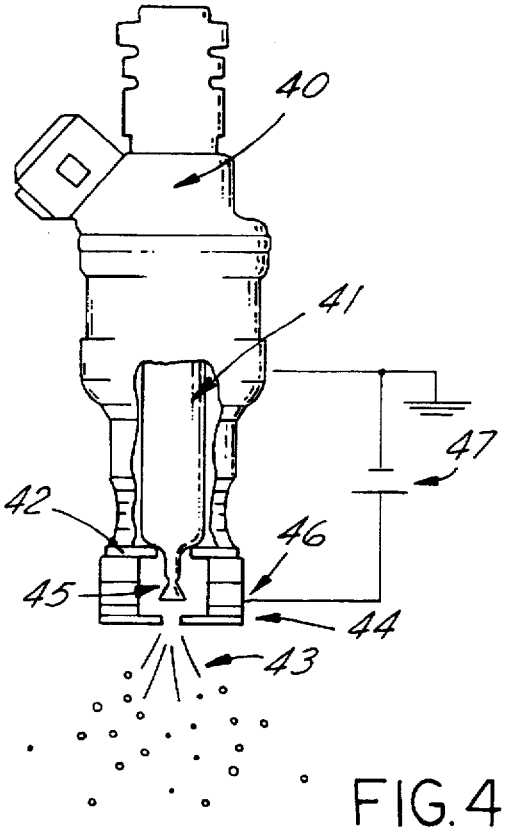
FIG. 4 is a schematic diagram illustrating a fuel injector which has been adapted with electrospray technology for producing a variable fuel spray pattern.

A number of existing technologies can be adapted to current fuel injectors to obtain a device having the range of dispersion and atomization necessary for the present application. One example is electrospray technology as taught in U.S. Pat. No. 4,991,744 to Kelly, and whose adaptation to current fuel injector designs is further taught in U.S. Pat. No. 5,234,170 to Schirmer et al. As shown schematically in FIG. 4, consider a fuel injector 40 of the common type in which a valve stem 41 is activated by a solenoid to move away from a valve seat 42 to allow fuel 43 to flow through and eventually out of the injector through a nozzle 44. This device can be adapted to electrospray technology by attaching a very sharp electric charge infusing electrode 45 to an extension of the valve stem while a much less sharp counter electrode 46 in the form of a small washer surrounds the infusing electrode. When the appropriate potential difference is established by power supply means 47 connected between these two electrodes, infused electrical charge is entrained in the liquid and carried out of the injector through the downstream nozzle. Because the electrical conductivity of the liquid is small, very little of the infused charge is electrically conducted to and discharged at the counter electrode. When the electric charge containing fuel exits the injector at the nozzle, the fuel spatially disperses and atomizes into charged droplets as the liquid attempts to minimize electrostatic energy. The larger the amount of infused charge, the greater will be the degree of dispersion and atomization.

The shape of the spray pattern will be determined by numerous parameters. Principal among these are the pressure that is applied to the liquid (several hundred kPa for a typical "low pressure" automotive fuel injection system), the structure of the orifices in the nozzle as well as the amount of infused charge. As an example, consider an orifice of the simplest type, a hole drilled into the nozzle plate with an axis parallel to that of the injector. Then, because the atomization appears to be at least in part a statistical process, one can realize a spray distribution similar to that qualitatively illustrated in FIG. 2*b* in which, from considerations of momentum imparted by the electric force, the most radially dispersed droplets are small and strongly charged, while the least dispersed are larger and weakly charged. As the infused charge is reduced in magnitude by reducing the potential between the electrodes, the spray distribution will approach a narrower, more columnar pattern with the radial dispersion resulting from the electric force occurring ever further downstream from the nozzle plate. At some point the amount of infused charge will be appropriate for directing the fuel to the port wall area that includes the back of the intake valve and the area just surrounding the valve. In this way, the cold start fuel preparation strategy discussed above could be implemented with an experimentally determined scheduling of the voltage to the electrospray electrodes that reduced cold start emissions to a minimum.

Other technologies might be adapted to produce variable spray patterns. For example, there are several forms of pressurized atomizers in which high pressure is used to give a liquid a large kinetic energy with respect to surrounding gases. When that velocity of the liquid is sufficiently large, it will disintegrate into a well atomized spray. In an appropriate design, further increases in pressure will cause increases in atomization and dispersion of the spray. Actuation and control of the pressure regulator will enable a variable spray pattern which could be used in an intake port in a manner similar to that described above for the electrospray adapted injector.

Figure 5:
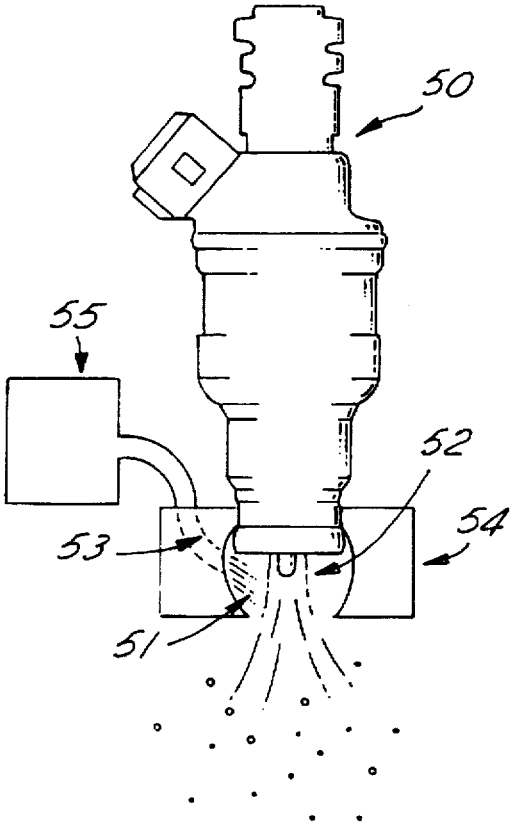
FIG. 5 is a schematic diagram illustrating a fuel injector which has been adapted with air-assisting technology to provide additional atomization and dispersion.

Illustrated in FIG. 5, air-assist atomizers are another type of atomizer which could be adapted for the variable spray pattern application. In an air-assist atomizer 50, a gas stream 51 of appropriate velocity is caused to impinge on a more slowly moving fuel stream 52 emanating from the injector thereby promoting atomization and dispersion. The gas flow is typically directed to the fuel stream through ducting 53, which is incorporated into a structure 54 attached to the downstream end of the injector. Actuation and control of the gas flow at a variable pressure gas pump 55 would provide the method for producing the variable spray pattern. To the extent that the gas flow causes the fuel flow rate to vary simultaneously with the spray pattern, compensation in the length of actuation time can be made to introduce the required amount of fuel into the port.

Various modifications and variations will no doubt occur to those skilled in the art to which this invention pertains. For example, there may be mechanical or piezoelectric methods for varying orifice diameters within the nozzle plate resulting in a corresponding change in spray dispersion which could be utilized to implement the variable fuel presentation strategy. Similarly, there may be piezoelectrically, electromagnetically or mechanically activated deflector plates and cones or other mechanical spray modifiers within the injector mechanism which could also be used to vary the fuel presentation for maximizing fuel evaporation in the port that is the principle improvement which this disclosure teaches. These and all other variations which basically rely on the teachings through which this disclosure has advanced the art are properly considered within the scope of this invention.

We claim:

1. A fuel injection system for an internal combustion engine comprising:

fuel injection means capable of a first off-on transition, a second on-off transition, and a third transition for temporally varying the spatial distribution and degree of atomization of fuel discharged into an intake air passageway of said engine; and, control means for regulating said injection means so that the resulting fuel discharge spray pattern produces a fuel distribution, both on the walls and within the air volume of said intake air passageway, thereby regulating evaporation of fuel in said passageway, both spatially and temporally during varied conditions of engine operation.

2. The system of claim 1 wherein said control means include an electronic engine controller for obtaining physical parameters relateing to a combustion process, for interpreting said parameters, and for regulating said injection means based on said parameters.

3. The system of claim 2 wherein said control means regulate said injection means based upon physical parameters relating to a combustion process so that the resulting fuel distribution within said intake air passageway improves the efficiency of, and reducing the level of emission arising from, the combustion of this fuel when it is subsequently inducted into a combustion chamber.

4. The system of claim 3 wherein said control means store and utilize data for the regulation of said injection means in a lookup table.

5. The system of claim 1 wherein said control means execute said third transition for varying the spatial distribution and degree of atomization of fuel from said injection means during an individual injector control pulse.

6. The system of claim 1 wherein said control means execute said third transition for varying the spatial distribution and degree of atomization of fuel from said injection means over a plurality of injector control pulses.

7. The system of claim 1 wherein said control means regulate said injection means during a transient period in which said engine is warming up after being started at a temperature near that of ambient air.

8. The system of claim 7 wherein said control means command a variable spray pattern from said injection means during the first few injection events after the engine is started from a temperature near that of ambient air so that fuel will be uniformly distributed over the interior surface of said air intake passageway from said injection means to the downstream end of the passageway and including the surface of an intake valve exposed to said passageway.

9. The system of claim 8 wherein said control means command a variable spray pattern from said injection means during the injection events subsequent to the first few injection events after the engine is started from a temperature near that of ambient air so that, up until said engine is fully warmed, fuel is deposited on the surface area of said air intake passageway increasingly further downstream of said injection means, and on the outer surface of an intake valve, so as to regulate fuel evaporation.

10. The system of claim 1 wherein said injection means include electrodes which impart electrical charge upon fuel leaving said injection means so that said fuel is atomized and dispersed in proportion to the amount of imparted charge.

11. The system of claim 1 wherein said injection means include a liquid fuel pressurizing means which can be regulated so that said fuel is atomized and dispersed in proportion to the amount of pressure applied.

12. The system of claim 1 wherein said injection means include an air pressurizing means so that pressurized air either flows by or is entrained into the injected fuel flow, the air pressure being regulated so that said fuel is atomized and dispersed in proportion to the amount of pressure applied.

13. A fuel injection system for an internal combustion engine comprising:

fuel injection means capable of a first off-on transition, a second on-off transition, and a third transition for temporally varying the spatial distribution and degree of atomization of fuel discharged into an intake air passageway of said engine; and, control means for regulating said injection means so that the resulting fuel discharge spray pattern produces a fuel distribution, both on the walls and within the air volume of said intake air passageway, thereby regulating evaporation of fuel in said passageway both spatially and temporally during varied conditions of engine operation, wherein:

said control means include an electronic engine controller for obtaining physical parameters relating to a combustion process, for interpreting said parameters, and for regulating said injection means based on said parameters;

said control means regulate said injection means based upon physical parameters relating to a combustion process so that the resulting fuel distribution within said intake air passageway improves the efficiency of, and reducing the level of this fuel where it is subsequently inducted into a combustion chamber;

said control means store and utilize data for the regulation of said injection means in a lookup table;

said control means execute said third transition for varying the spatial distribution and degree of atomization of fuel from said injection means during an individual injector control pulse;

said control means execute said third transition for varying the spatial distribution and degree of atomization of fuel from said injection means over a plurality of injector control pulses;

said control means regulate said injection means during a transient period in which said engine is warming up after being started at a temperature near that of ambient air;

said control means command a variable spray pattern from said injection means during the first few injection events after the engine is started from a temperature near that of ambient air so that fuel is uniformly distributed over the interior surface of said air intake passageway from said injection means to the downstream end of the passageway and including the surface of an intake valve exposed to said passageway; and said control means command a variable spray pattern from said injection means during the injection events subsequent to the first few injection events after the engine is started from a temperature near that of ambient air so that, up until said engine is fully warmed, fuel is deposited on the surface area of said air intake passageway increasingly further downstream of said injection means, and on the surface of an intake valve exposed to said air intake passageway, so as to regulate fuel evaporation.

14. The system of claim 13 wherein said injection means include electrodes which impart electrical charge within fuel leaving said injection means so that said fuel is atomized and dispersed in proportion to the amount of imparted charge.

15. The system of claim 13 wherein said injection means include a liquid fuel pressurizing means which can be regulated so that said fuel is atomized and dispersed in proportion to the amount of pressure applied.

16. The system of claim 13 wherein said injection means include an air pressurizing means so that pressurized air either flows by or is entrained into the injected fuel flow, the air pressure being regulated so that said fuel is atomized and dispersed in proportion to the amount of pressure applied.

* * * * *